US008312940B2

(12) United States Patent
Bailey et al.

(10) Patent No.: US 8,312,940 B2
(45) Date of Patent: Nov. 20, 2012

(54) APPARATUS AND METHOD FOR IMPROVEMENTS IN WELLBORE DRILLING

(75) Inventors: Louise Bailey, St. Neots (GB); John Cook, Cambridge (GB); Jennifer Edwards, Auckland (NZ); Gerald Meeten, Ware (GB); Jonathan Phipps, Gorran Haven (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/598,628

(22) PCT Filed: May 30, 2008

(86) PCT No.: PCT/GB2008/001817
§ 371 (c)(1),
(2), (4) Date: Mar. 18, 2010

(87) PCT Pub. No.: WO2008/149063
PCT Pub. Date: Dec. 11, 2008

(65) Prior Publication Data

US 2010/0175924 A1 Jul. 15, 2010

(30) Foreign Application Priority Data

Jun. 2, 2007 (GB) ..... 0710563.8

(51) Int. Cl.
*E21B 17/10* (2006.01)

(52) U.S. Cl. ..... 175/325.3; 166/344; 166/57

(58) Field of Classification Search ..... 175/72, 175/54, 56, 380; 507/100
See application file for complete search history.

(56) References Cited

U.S. PATENT DOCUMENTS

| | | | | |
|---|---|---|---|---|
| 2,776,111 | A | 1/1957 | Vance | |
| 3,123,159 | A * | 3/1964 | Buck | 175/67 |
| 6,513,601 | B1 | 2/2003 | Gunnarsson et al. | |
| 7,013,992 | B2 * | 3/2006 | Tessari et al. | 175/57 |
| 2005/0167159 | A1 * | 8/2005 | Bailey et al. | 175/72 |
| 2006/0144620 | A1 * | 7/2006 | Cooper et al. | 175/57 |

FOREIGN PATENT DOCUMENTS

| | | | |
|---|---|---|---|
| GB | 2396365 | A | 6/2004 |
| GB | 2418212 | A | 3/2006 |
| GB | 2409690 | B | 10/2006 |
| RU | 2235190 | C2 | 8/2004 |

OTHER PUBLICATIONS

Bailey et al: "Filtercake integrity and reservoir damage", SPE International Symposium on Formation Damage Control, Lafayette, Louisiana, Feb. 18-19, 1998, SPE 39429.

Borland et al: "Casing directional drilling is ready to go offshore", World Oil, Mar. 2006, pp. 33-38.

(Continued)

*Primary Examiner* — Daniel P Stephenson
*Assistant Examiner* — Yong-Suk (Philip) Ro
(74) *Attorney, Agent, or Firm* — Steven A. Gahlings; Rachel Greene

(57) ABSTRACT

A tool for use in wellbore drilling that is suitable for use with a drill string for drilling a wellbore having an inner wall. The tool comprises a cylindrical abrasion surface for contacting the inner-wall and generating particles of solid material, and a smearing device coupled with the drill string for applying radial and circumferential force to smear the generated particles onto the inner wall of the wellbore.

9 Claims, 2 Drawing Sheets

OTHER PUBLICATIONS

Fontenot et al: "Casing while drilling 'smear effect' improves wellbore stability", World Oil, Mar. 2006, p. 27-30.
Fontenot et al: "Casing drilling activity expands in South Texas", SPE/IADC Drilling Conference, Amsterdam, The Netherlands, Feb. 19-21, 2003, SPE/IADC 79862.
Fontenot et al: "Casing drilling proves successful in South Texas", World Oil, Oct. 2002, pp. 27-32.
Shepard et al: "Casing drilling: an emerging technology", SPE Drilling & Completions, Mar. 2002, pp. 4-14.
Warren et al: "Directional drilling with casing", SPE/IADC Drilling Conference, Amsterdam, The Netherlands, Feb. 19-21, 2003, SPE/IADC 79914.

* cited by examiner

APPARATUS AND METHOD FOR IMPROVEMENTS IN WELLBORE DRILLING

TECHNICAL FIELD

The invention relates to improvements in wellbore drilling apparatus and drilling method, particularly, but not limited to, addressing difficulties encountered when drilling through regions of both permeable and impermeable material.

BACKGROUND

To obtain fluids, such as oil and gas, from a subterranean reservoir wellbores are drilled from the surface into the reservoir. The most commonly applied method to drill a well uses a derrick or mast structure, in which a drill string is assembled and continuously extended into the wellbore as the drilling progresses. Drilling is performed by rotating a drill bit attached to the end of the drill string. During the drilling process pressurized drilling fluid (commonly known as "mud" or "drilling mud") is pumped from the surface into the hollow drill string. The main functions of the mud are to clean cuttings out of the wellbore, to cool the drill bit and to apply stress and pressure to the surface of the wellbore. The mud is carefully designed to achieve these objectives, the main parameters being its chemical composition, its additives and its density.

When the end of a drilling section is reached, the drill string and bit are withdrawn and steel pipe is lowered into the hole, which usually provides a fairly close fit to the hole. When the casing is in place, cement may be pumped down the inside and up the annulus and allowed to set. After such a casing operation, a further section of well may be drilled with a smaller diameter than the cased section.

Generally, the pressure exerted by the drilling fluid is greater than the formation or pore pressure so as to prevent the entry of formation fluids into the wellbore during the drilling process. As a beneficial side effect, when drilling through permeable rock, a small amount of pressurized mud may enter into porous sections of the formation from the wellbore and as it flows across the porous sections the mud may leaving behind a layer of larger particles on the wellbore wall. This layer left on the wellbore wall is commonly referred to as filter or mud cake. The mud cake may act to prevent further fluid loss into the permeable rock, which can be harmful, damaging formation permeability and lubricating fractures.

The barrier provided by the mud cake can potentially increase the so-called "mud window". The mud window is a pressure range in which the driller maintains the mud pressure. The mud pressure should be sufficiently high to prevent influx from the formation whilst being low enough to prevent a fracturing of the formation and lost circulation. A wider mud window has the advantage of effectively increasing the distance that can be drilled before the open wellbore requires a casing. With an increased distance between subsequent casing shoes or points, the drilling operation can be completed in a shorter time period and at reduced costs.

Considerable efforts have therefore been made to optimize the mud cake as a protective layer—mostly by adding suitable chemical compositions to the base drilling fluid—in order to increase the stability of the mud cake and the adjacent formation or to increase the capability of the mud cake layer to isolate the wellbore from the surrounding formation.

In a specific branch of drilling techniques, casing may itself be used as the drill string so that the well is simultaneously drilled and cased. This method is commonly referred to as "casing drilling". Under certain circumstances, casing drilling has been shown to reduce the in-hole trouble time significantly below that obtained by conventional drilling, hence reducing overall drilling costs.

Casing drilling has been identified as a technology that may be capable of reducing or minimizing problems associated with conventional drilling, such as stuck pipe, lost circulation, well control, and failure to run casing. It has been shown that the incidence of wellbore stability, lost circulation, influx and drag while tripping out are significantly reduced when using casing drilling compared to conventional drilling methods.

It has also been suggested that casing drilling provides a wellbore that is more stable and less permeable than drilling with a conventional drill pipe and collars. Desirable attributes associated with casing drilling may be at least partly attributable to so-called "mud cake" or the effects of mud cake as the process of casing drilling may mechanically strengthen the wellbore by building and maintaining an impermeable layer of the mud cake on the wellbore. US 2005/0167159A (Bailey et al.), incorporated by reference herein, discloses a mud suitable for use when casing drilling, comprising a conditioning additive designed to increase the strength of the filter cake.

However, for conventional drilling and even for casing drilling despite the improvements associated with such drilling technique, significant problems are still present particularly when drilling through impermeable material, particularly shale and mudstone formations, or when a transition from permeable to impermeable material is encountered.

SUMMARY

In a first aspect, the invention provides a tool for use in wellbore drilling, suitable for use with a drill string for drilling a wellbore having an inner wall, the tool comprising means for generating particles of solid material from the formed inner wall of a drilled wellbore, and means for mechanically directing the generated particles to the inner wall of the wellbore.

The tool is intended to be secured to a drill string to rotate therewith in use.

In a typical arrangement, drilling mud is fed down through the drill string to the drill bit in conventional manner. At least part of the drilling fluid then passes upwards through the annular region between the tool and the formed inner wall. As it flows upwards, some of the drilling fluid will typically mix with the generated particles to form a mixture, usually in the form of a paste. Typically the generated particles are mechanically directed to the inner wall in the form of such a mixture.

In a further aspect the invention provides a method of forming a layer of solid particles on the inner wall of a wellbore drilled by a wellbore drilling tool, the drilling tool comprising a tool comprising means for generating particles of solid material from the formed inner wall, and means for directing the generated particles to the inner wall wherein the solid particles generated by the means for generating particles are subsequently directed to the inner wall by the means for directing the particles thereby forming the layer of solid particles.

In a further aspect the invention provides a method of forming a wellbore with a wellbore drilling tool and forming a layer of solid particles as described above.

In a further aspect, the invention provides a paste material comprising drilling mud and solid particles generated from impermeable rock encountered when drilling a wellbore, and also provides a wellbore comprising a layer of such a paste material on its inner wall.

In this way, the mixture, typically a paste-like material, can fill cracks in the inner wall and build up a wall coating providing the advantages of a mud cake, even when drilling through impermeable rock, such as shale and mudstone. Effectively the invention allows for a reduction of common problems which are capable of being reduced by casing drilling, even when drilling through impermeable rock.

Furthermore, when drilling from a region having a high "mud window" to a region having a lower, non-overlapping, "mud window", the present invention can be employed in the low "mud window" region to prevent lost circulation without having to stop to case the drilled wellbore, thus allowing a drilling operation to be completed in a shorter time period and at reduced cost.

It is believed that, because cracks are sealed by mechanically directing generated particles, e.g. in the form of a mixture, into the cracks, as opposed to being directed by fluid pressure, then cracks will not propagate, thus reducing or eliminating lost circulation.

Shales are extremely fine-grained materials, largely composed of clay minerals with very high specific surface area. They are produced by the compaction of mud, passing through stages of increasing viscosity and strength, and forming thick pastes, stiff soils, soft rocks, and eventually hard brittle rocks (and after that, gneiss). Much of the compaction is mechanical, but chemical interactions and alteration can play a significant part (in both interparticle forces and the modification of the clay chemistry by diagenesis and low-grade metamorphism). The compaction process is not reversible—uplifted shales do not decompact. In order to return the material to a paste state, the clay particles in the shale must be partially separated by a means for generating particles, and fluid introduced between them. This can be achieved by use of a tool in accordance with the invention.

Generating Particles

The most preferred method of generating particles is to employ a means for abrading the formed inner wall. There are numerous ways in which this may be employed.

One preferred approach is to use a substantially cylindrical abrasion surface arranged coaxially with the formed wellbore and rotating with the drill string to provide passive abrasion. Another possibility is wherein the means for abrading the formed inner wall is adjustable or movable between an inactive state when no abrasion occurs in use and an active state when abrasion occurs in use. For example, an abrasive surface could be provided on at least one of the retractable pads of a so-called Power Drive tool, such that the pad can be selectively extended to bring it into contact with the formed inner wall or retracted to move it out of contact.

Merely by way of example, the following are means for abrading the formed inner wall of the wellbore that may be used in various aspects of the present invention.

- A simple abrasive surface on the outer diameter of stabilizer blades on drill collars.
- A simple abrasive surface on a device similar to PowerDrive pad, that can be deployed against the wellbore wall, with a specified force, as required.
- An abrasive roller, in a drill collar or a PowerDrive pad, that can be allowed to rotate freely, or can be braked so that it starts to abrade.
- An array of orbiting abrasive elements, such as diamond wheel points, e.g. on a PowerDrive pad.
- A slightly overgauge fixed cutter on the bit or other part of a bottom hole apparatus.
- An abrasive surface or array of abrasive elements which vibrate, e.g. parallel to the face of the wall of the wellbore.

Methods of generating particles other than by abrasion may be envisaged in other aspects of the present invention, such as those based on sonic or acoustic production of fine shale particles close to the wellbore wall.

Once the particles have been generated they will typically mix together with surrounding fluid, such as drilling mud. This will generally form a mixture, e.g. a paste, which in an aspect of the present invention may be directed to the inner wall by mechanical means or the like. Particles with a particle size of less than 500 micrometers may provide for a suitable paste-like mixture. In certain aspects, particles with a particle size from 1 to 20 micrometers may be used to form the paste-like mixture. In further aspects, pastes with a solids fraction of greater than 0.1 may be used.

Mechanically Directing the Particles to the Wall

When the particles, e.g. in the form of a mixture, have been generated they are subsequently mechanically directed or the like to the inner wall. This may involves the particles being squeezed into incipient fractures in the wall providing for creating a block against fluid flow and pressure transmission through the incipient fractures. In an embodiment of the present invention, mechanical direction may be necessary because, in many applications, the faces of the incipient fractures may be essentially impermeable. Fluid pressure alone may be insufficient because, either the fracture contents will appear to be incompressible and will resist the entry of the particles, or the fracture will propagate under the wellbore fluid pressure, which is a condition the present invention aims to prevent.

Suitably, in one embodiment of the present invention, the means for directing the particles is capable of mechanically forcing the particles, e.g. in the form of a mixture, into fractures. For example, in certain aspects, a device that is configured to provide a smearing action on the wellbore wall may be used, including having, in certain aspects, one or more surfaces for applying radial and circumferential force to the particles in paste form. An arrangement comprising a plurality of curved hinged vanes may be used in some aspects of the present invention. There are numerous ways in which the means for directing the particles could be arranged in the tool, e.g. mounted in a collar or in a PowerDrive pad.

In some embodiments of the present invention, the means for mechanically directing the particles is positioned upstream, in the direction of drilling (i.e. downstream of flow of returning mud flow) of the means for generating particles. In this way fewer particles will be lost to flowing mud and more particles are likely to be forced into fractures in the wall. Additionally, the means for mechanically directing the particles and the means for generating particles may be adjacent to one another (i.e. in close proximity or even in physical contact), and may be carried on a common collar for attachment to a drill string.

Fractures in rock formations, e.g. shale do not necessarily form at the drill bit. It is often the case that time-dependent effects, in both the rock itself and the drilling process, cause fracturing (either shear or tensile) up the wellbore. A combination of a particle generating means and a means for mechanically directing particles close to the bit would not address these potential problems. Therefore, in some embodiments paste may be generated in a distributed method, e.g. along the entire section of open wellbore. Thus, in such embodiments, a drillstring may comprise a plurality of tools according to the present invention spaced at intervals along the length of the drillstring.

Complicated particle generating devices may not be easily employed in a distributed approach, so in certain aspects of the present invention, a simple abrasive surface may be used as the means for generating particles. In some aspects of the present invention, perhaps a smooth smearing surface may be used as the means for mechanically directing the generated particles. The devices may be disposed on the drill pipe, the bottom hole assembly or the like, and in some instances may be deployed on the near-fullbore drillpipe protectors, often used in drilling horizontal wells. Such protectors may be spaced at regular intervals along a drillstring.

As already discussed, the present invention may be employed in regions of impermeable rock, and in regions of impermeable rock containing fractures. However, in other types of regions, such as under conditions where there are no fractures to block, the generated particles will may join the circulated mud flow, and the whole process may be used to generate a thicker and/or more resilient mud cake, but the slightly higher solids content in the mud (since the particles will disperse into it) may produce marginally higher torque and drag values, because of the extra friction of the abrader.

It therefore may be advantageous that the particles are not excessively removed by the circulating mud before fractures have been exposed to them. Similarly, the shear strength of any mud-shale mixture should not be lessened from dilution by the circulating mud before fractures have been exposed to it. Thus, in one embodiment, the tool may comprise a mud flow channel, reducing the quantity of mud flowing near the inner wall. One example of how this may be achieved is for the drilling tool to comprise an annular sleeve which surrounds the drilling tool body and comprises channels to allow the passage of drilling mud.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The invention will now be illustrated with reference to the following figure, in which.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, structures, and other components may be shown as components in block diagram form in order not to obscure the embodiments in unnecessary detail. In other instances, well-known processes, techniques, and other methods may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. Furthermore, any one or more operations may not occur in some embodiments. A process is terminated when its operations are completed, but could have additional steps not included in a figure. A process may correspond to a method, a procedure, etc.

Figures 1A, 1B:
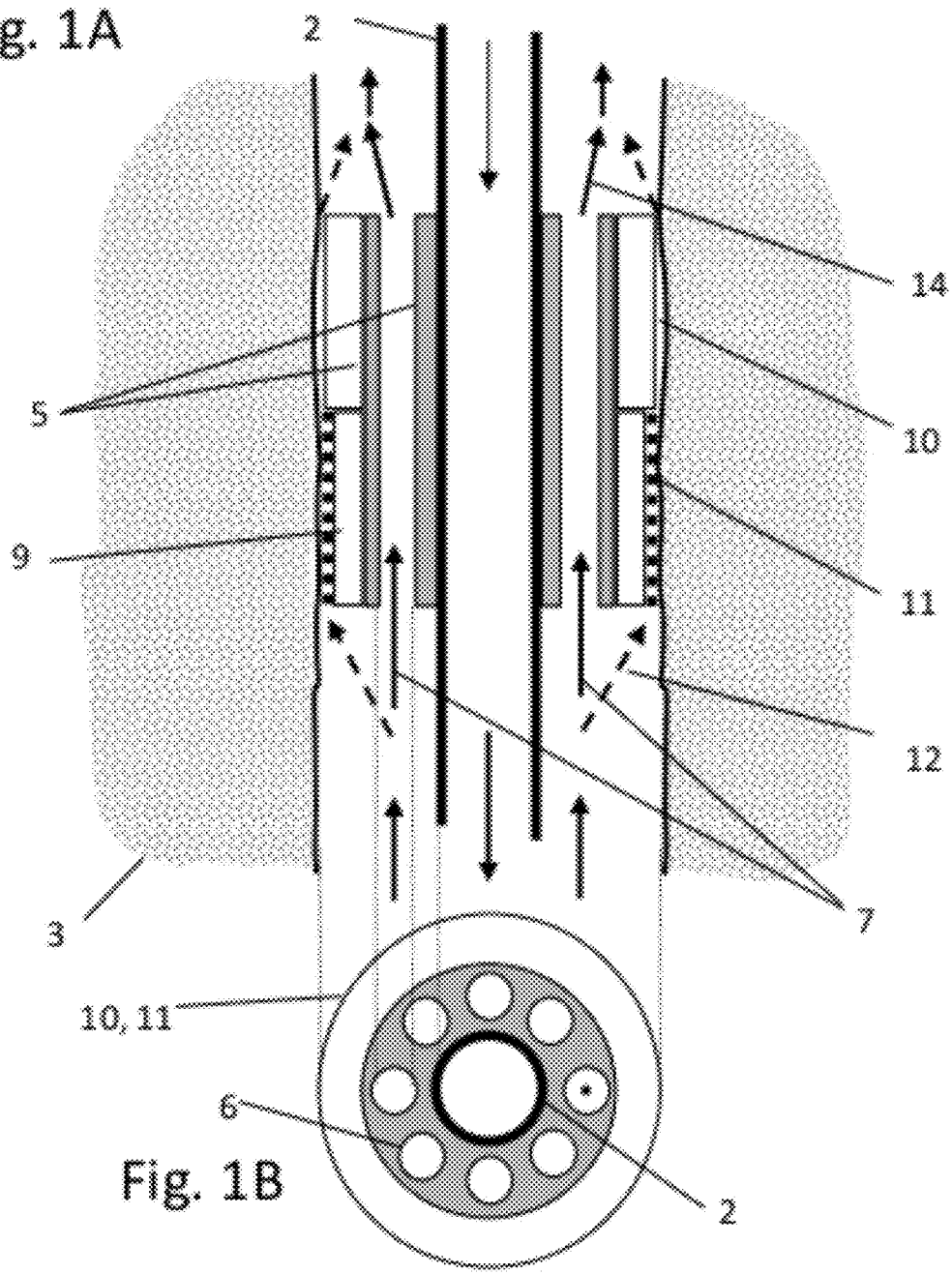
FIG. 1A is a schematic side-sectional view of a casing drilling drill string carrying a tool in accordance with the invention passing through a wellbore.
FIG. 1B is an orthogonal sectional view through an upper part of the tool shown in FIG. 1A.

FIG. 1 shows schematically part of a hollow tubular drill string 2 passing through impermeable rock formation 3 of shale and extending from surface installation (not shown) to drill bit (not shown).

A tool in accordance with the invention may comprise sleeve 5 fixed to rotate with the drill string 2 and comprising six holes 6 constituting means for directing flowing drilling mud away from the inner wall of the wellbore. The number of holes in the depicted embodiment is merely illustrative and a different number of holes may be used in other embodiments of the present invention. Attached to the sleeve 5 is a cylindrical body 9 having a number of small abrasive elements 11, the cylindrical body 9 and abrasive elements 11 constituting means for generating particles. Also attached to the sleeve 5, upstream in the direction of drilling, is a means for mechanically directing the generated particles 10 to the inner wall of the wellbore, shown schematically. The means for mechanically directing the generated particles 10 can include smooth or rotating roller surfaces.

In use, drilling mud 1 is pumped down through the drill string 2 to the drill bit (not shown). The drilling mud returns flowing upwards, the majority of which passes through holes 6 along the path 7, 14. A minority of drilling mud follows path 12 to flow between the inner wall of the drilled wellbore and the tool.

As drilling proceeds the drill string and the tool in accordance with the invention rotate. The abrasive elements 11 generate fine particles of shale by abrading the inner wall of the wellbore.

The mud following path 12 mixes with the generated shale particles and forms a paste-like mixture.

The paste-like mixture then passes downstream of flowing mud 12 and is brought into contact with means for directing the generated particles 10, which preferably comprises a rotating roller surface (not shown). The rotating roller surface mechanically forces the paste-like mixture against the formed inner wall with both radial and circumferential force. Any cracks or fractures in the formed inner wall are filled by the paste-like mixture. Additionally the outer face of the inner wall is coated in a layer of the paste-like material.

Figure 2:
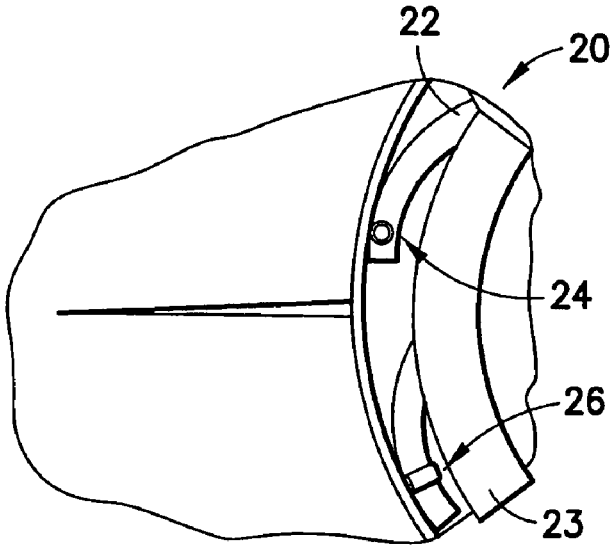
FIG. 2 is a schematic sectional view of part of a Power Drive device comprising abrasion means in accordance with the invention in contact with the wall of a wellbore.

FIG. 2 shows schematically part of a Power Drive device 20 being employed as means for generating particles of shale. The Power Drive device 20 comprises arms 22, 23 which are adjustable between an inactive state, where they are retracted to fold into the body of the Power Drive device, and an active state where they are extended to contact the inner wall of formed wellbore. Positioned at a contacting point of arm 22 is an abrader 24. Positioned at a contacting point of arm 23 is a micro-hammer 26.

In use, the Power Drive device 20 rotates with the drill string (not shown) and one or more of the arms 22, 23 is adjusted into its active state. One of the means for abrading the surface of the inner wall 24, 26 begins to generate particles of shale. Returning drilling mud (not shown) mixes with the generated particles and forms a paste-like mixture which can be directed into fractures 28 by means for directing particles to the inner wall (not shown).

Figure 3:
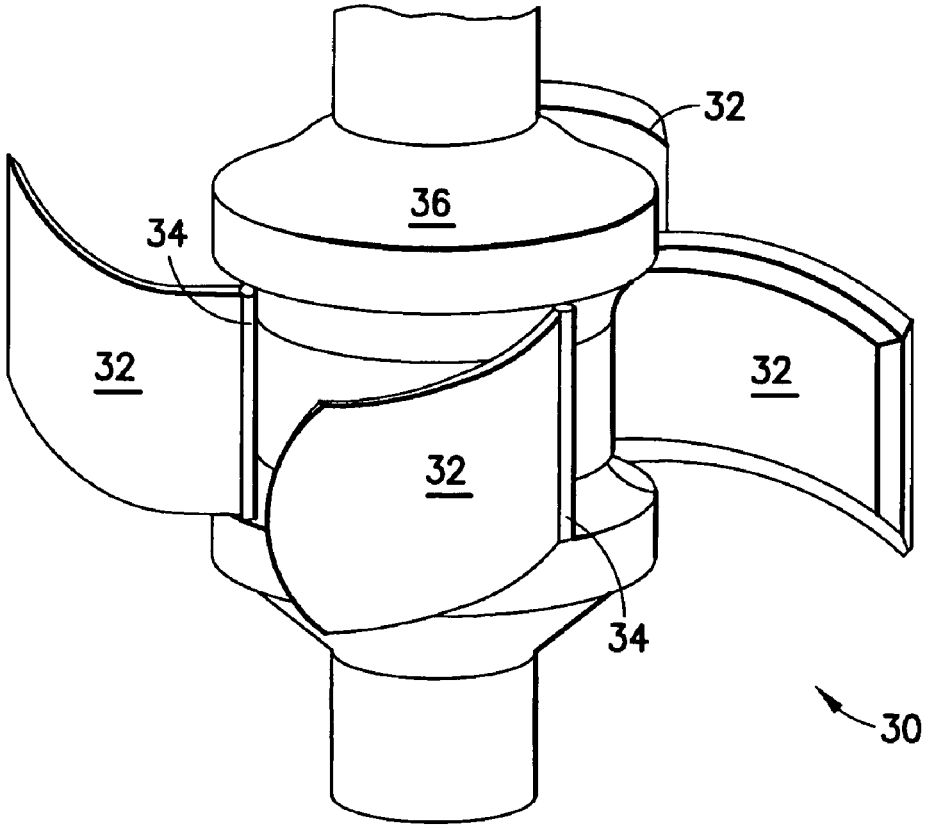
FIG. 3 is a view of a roller device in accordance with the invention comprising means for mechanically directing particles.

FIG. 3 shows a roller device 30 comprising four vanes 32 each mounted on hinges 34 to a control hub 36. The vanes 32 are biased to fold into contact with the hub 36. The device is intended to form part of a drill string and constituting means for mechanically directing generated particles to the inner wall.

In use, drilling mud passes through the centre of the roller device and activates internal cylinders (not shown) which rotate the vanes 32 outwards, bringing their distal ends into contact with the formed inner wall of a wellbore (not shown). The distal ends constitute smearing surfaces and apply both radial and circumferential force to particles, e.g. in the form of a paste to force the particles into any fractures in the inner wall and to produce a relatively smooth paste coating on the inner wall.

The invention has now been described in detail for the purposes of clarity and understanding. However, it will be appreciated that certain changes and modifications may be practiced within the scope of the appended claims.

What is claimed is:

1. A tool for use in wellbore drilling, suitable for use with a drill string for drilling a wellbore having an inner wall, the tool comprising:

a cylindrical abrasion surface coupled with the drill string and arranged coaxially with the formed wellbore and configured to generate particles of solid material with a particle size of less than 500 micrometers from the formed inner wall of the wellbore; and a smearing device coupled with the drill string upstream of, vertically above, the cylindrical abrasion surface and comprising one or more surfaces for applying radial and circumferential force to smear the generated particles onto the inner wall of the wellbore.

2. The tool according to claim 1, wherein the cylindrical abrasion surface is adjustable or movable between an inactive state when no abrasion occurs in use and an active state when abrasion occurs in use.

3. The tool according to claim 1, wherein the smearing device and the cylindrical abrasion surface are adjacent to one another.

4. The tool according to claim 3, wherein the smearing device and the cylindrical abrasion surface are carried on a common collar for attachment to a drill string.

5. The tool according to claim 1, further comprising:

flow paths through the drill string for directing flowing drilling mud away from the inner wall of the wellbore.

6. A drill string comprising at least one tool in accordance with claim 1.

7. The drill string according to claim 6, comprising a plurality of tools spaced at intervals along the length of the drill string.

8. A method of forming a layer of solid particles on the inner wall of a wellbore drilled by a wellbore drilling tool, the drilling tool comprising:

using an abrading surface to abrade the inner wall of the wellbore to generate particles of solid material with a particle size of less than 500 micrometers from the formed inner wall of the wellbore; and using a smearing device coupled with the drill string upstream of, vertically above, the cylindrical abrasion surface to apply a radial and circumferential force to smear the generated particles onto the inner wall of the wellbore.

9. The method according to claim 8, wherein the layer of particles is formed on the inner wall of an impermeable rock.

* * * * *